US005603437A

United States Patent [19]

Zuckerman

[11] Patent Number: 5,603,437

[45] Date of Patent: Feb. 18, 1997

[54] GARMENT HANGER, SIZE INDICATOR AND COMBINATION THEREOF

[75] Inventor: Andrew M. Zuckerman, Forest Hills, N.Y.

[73] Assignee: Different Dimensions Inc., Rego Park, N.Y.

[21] Appl. No.: 511,831

[22] Filed: Aug. 7, 1995

[51] Int. Cl.[6] ..... A47G 25/14

[52] U.S. Cl. ..... 223/85; 40/322

[58] Field of Search ..... 223/85, 92, 95; 40/322, 666, 669, 606

[56] References Cited

U.S. PATENT DOCUMENTS

| | | | |
|---|---|---|---|
| D. 244,197 | 5/1977 | Ostroll . | |
| D. 264,912 | 6/1982 | Bliss et al. . | |
| D. 302,214 | 7/1989 | Wilson . | |
| D. 303,325 | 9/1989 | Marshall . | |
| 2,074,841 | 3/1937 | Haimowitz . | |
| 2,099,596 | 11/1937 | Bruening . | |
| 2,288,071 | 6/1942 | Cohen . | |
| 2,658,627 | 11/1953 | Magnuson . | |
| 2,940,145 | 6/1960 | Fernberg | 40/666 |
| 3,024,953 | 3/1962 | O'Keefe . | |
| 3,313,135 | 4/1967 | Reisner | 24/616 |
| 3,685,189 | 8/1972 | Conger . | |
| 3,949,914 | 4/1976 | Ostroll . | |
| 4,006,547 | 2/1977 | Samuels et al. . | |
| 4,115,940 | 9/1978 | Phillips . | |
| 4,137,661 | 2/1979 | Johansson . | |
| 4,322,902 | 4/1982 | Lenthall . | |
| 4,450,639 | 5/1984 | Duester . | |
| 4,714,156 | 12/1987 | Kolton et al. . | |
| 4,886,195 | 12/1989 | Blanchard . | |
| 5,096,101 | 3/1992 | Norman et al. | 223/92 |
| 5,199,608 | 4/1993 | Zuckerman . | |
| 5,238,159 | 8/1993 | Zuckerman | 223/85 |
| 5,383,583 | 1/1995 | Zuckerman . | |
| 5,388,354 | 2/1995 | Marshall et al. . | |
| 5,441,182 | 8/1995 | Sullivan | 223/85 |

FOREIGN PATENT DOCUMENTS

| | | |
|---|---|---|
| B15598880 | 12/1977 | Australia . |
| A4231878 | 12/1978 | Australia . |
| A15701180 | 3/1980 | Australia . |
| WO8304122 | 11/1983 | Australia . |
| A3200884 | 8/1984 | Australia . |
| 518708 | 3/1972 | Switzerland . |
| WO9009651 | 8/1990 | WIPO . |

*Primary Examiner*—Bibhu Mohanty
*Attorney, Agent, or Firm*—Amster, Rothstein & Ebenstein

[57] ABSTRACT

In combination, a molded plastic garment hanger and a molded plastic indicator. The molded plastic indicator includes a solid body adapted to display indicia relating to a garment on said hanger. The body includes sidewalls, end walls, a bottom wall and a top wall, each body sidewall defining with the body bottom wall intermediate the body end walls and under the body top wall an outwardly extending lateral projection. The molded plastic garment hanger includes a hook adapted to engage a rod or other support, and a transversely spaced pair of upwardly projecting generally planar webs which receive the indicator, each of the webs defining an aperture therethrough for receiving a respective one of the lateral projections in an interference fit. A portion of the body is configured and dimensioned to be snugly received intermediate the hanger webs with the body lateral projections extending outwardly through the web apertures.

30 Claims, 3 Drawing Sheets

FIG. 1
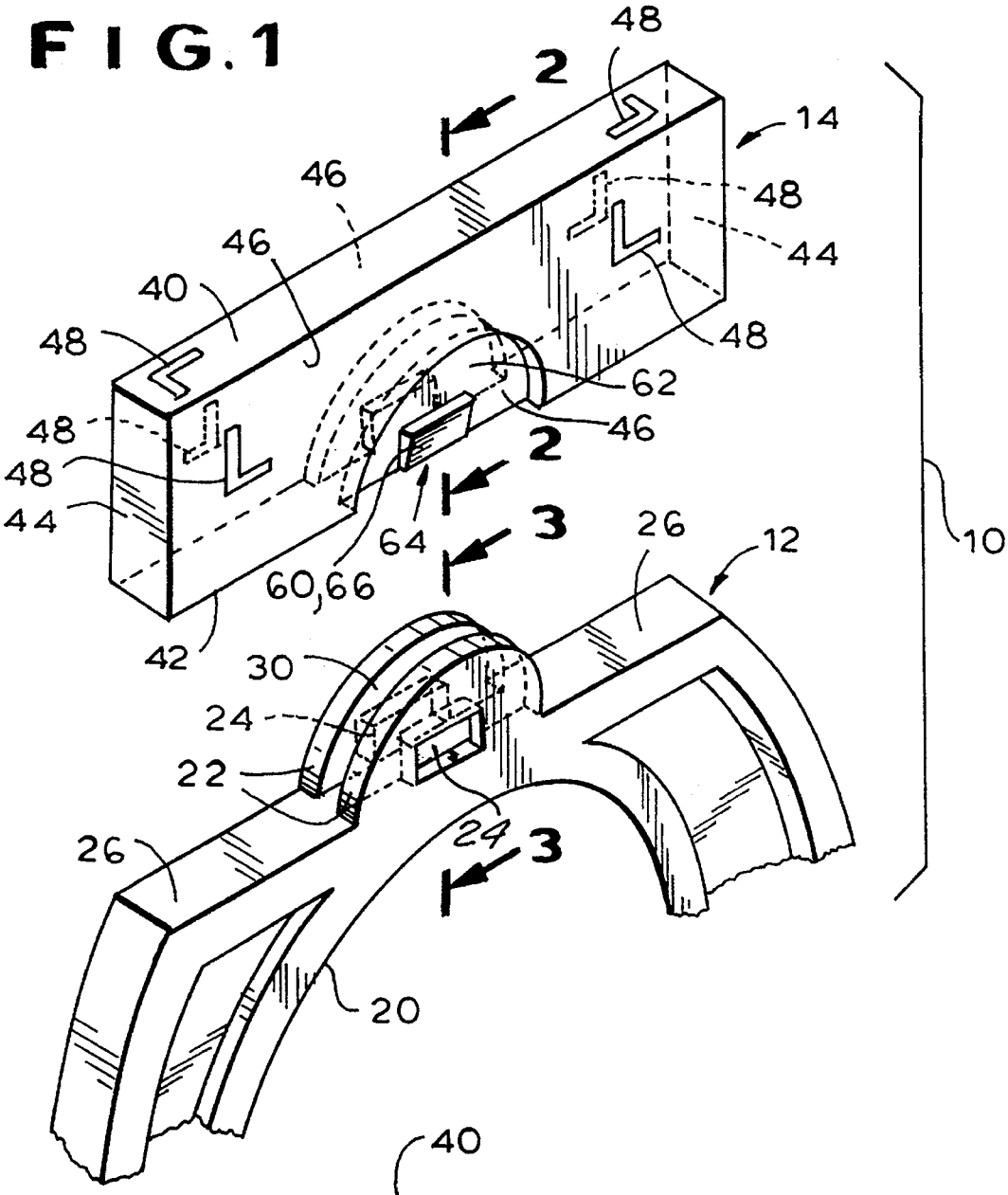
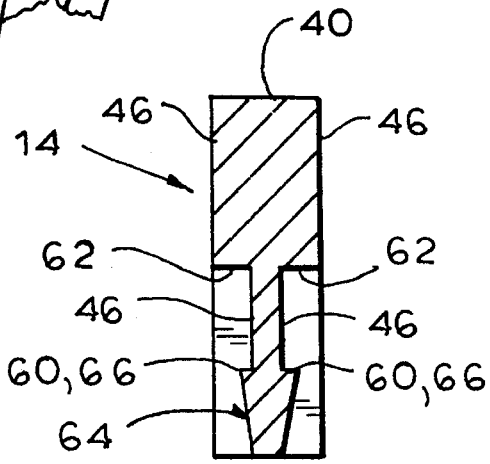
FIG. 2
FIG. 3
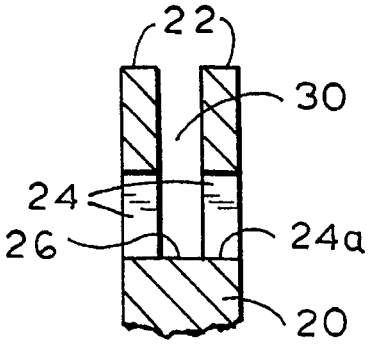

FIG. 4
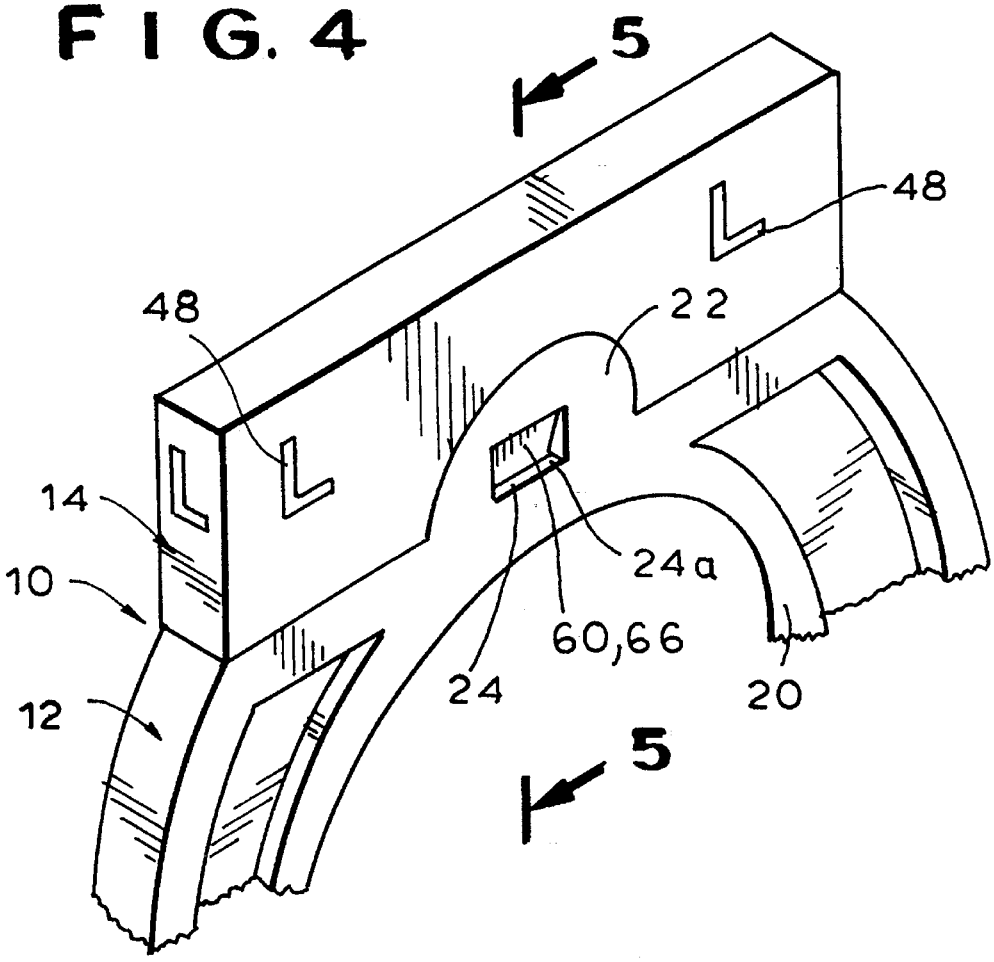
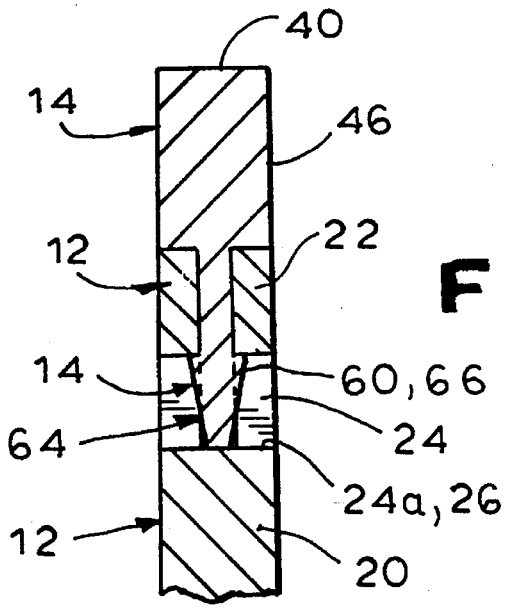
FIG. 5

FIG. 6
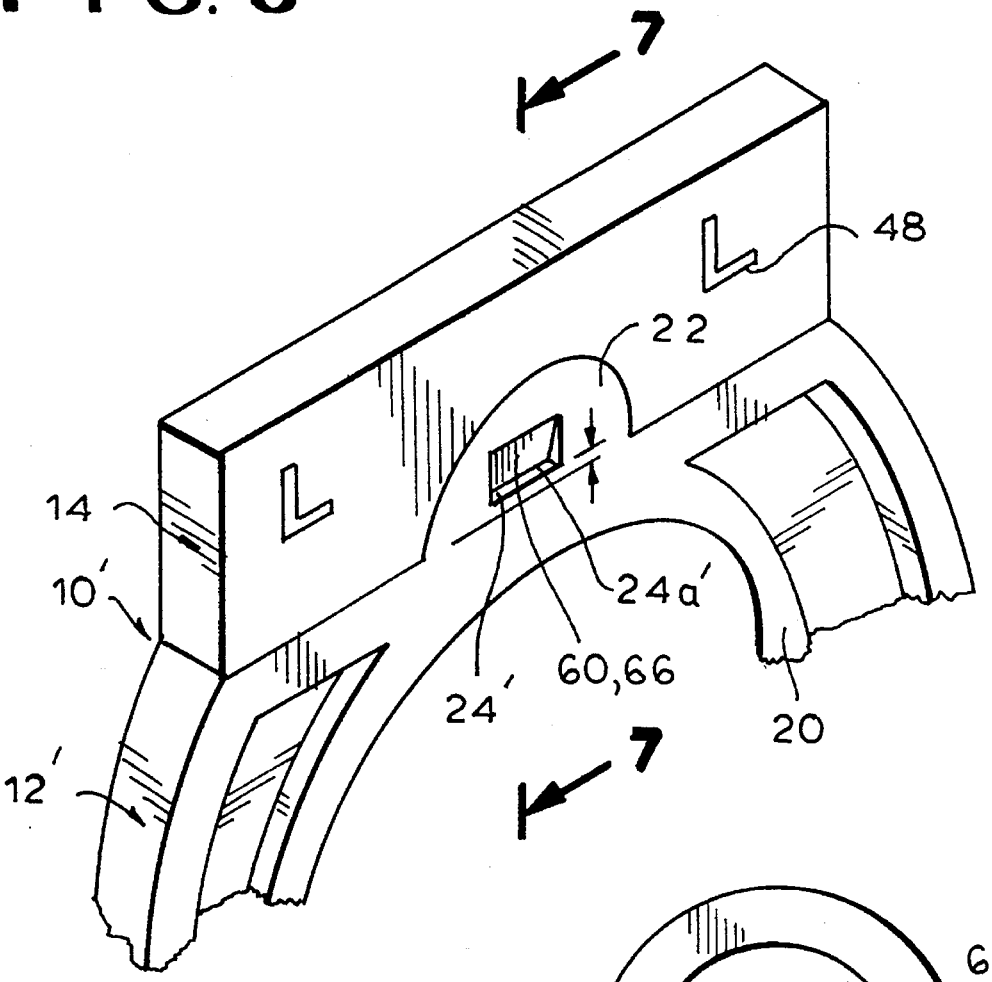
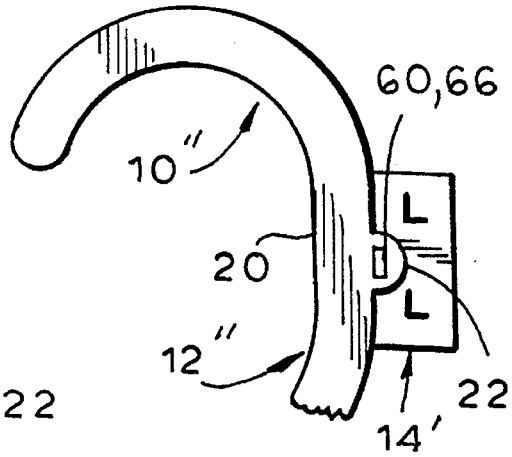
FIG. 8
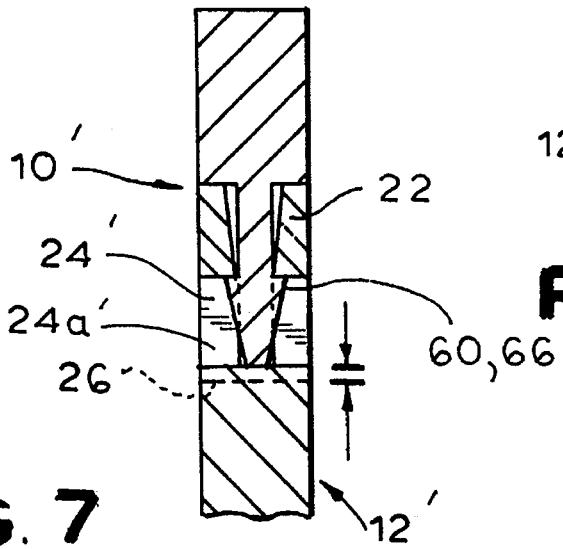
FIG. 7

GARMENT HANGER, SIZE INDICATOR AND COMBINATION THEREOF

BACKGROUND OF THE INVENTION

The present invention relates to a garment hanger, an indicator of the type which may be used to indicate the size of a garment supported by the hanger and/or the name of the manufacturer or retailer, etc., and a combination thereof.

U.S. Pat. No. 5,388,354 is typical of the garment hangers, indicators and combinations thereof used in the prior art. The upper portion of the hook of the hanger is releasably received within an open-bottom cavity of the hollow indicator. The hook portion defines an outwardly extending lateral projection on either side thereof, and the indicator defines an aperture extending from the cavity thereof through a respective side thereof. The indicator can flex laterally outwardly over the projections as it is being mounted on the hanger, but thereafter the hanger projections enter the indicator apertures and the indicator resumes its original configuration.

Garment hanger/indicator combinations of this type have not proven to be entirely satisfactory. It is more difficult to manufacture a hollow indicator (that is, an indicator with a cavity therein) than a solid indicator. It is even more difficult to manufacture a hollow indicator having apertures therein than an unapertured hollow indicator. This difficulty in manufacture translates into additional production line costs as well as additional production line rejects.

The hollow indicators tend to stretch out after insertion and removal from a hanger. A solid indicator would be more durable than a hollow indicator, thereby enabling re-use of the indicator and thus lowering its per use cost. A solid indicator would also facilitate the use of raised lettering (or like raised labeling) as the indicia thereon. Further, a solid indicator would enable the indicator to be made very slim (i.e., long and thin), relative to a hollow indicator Accordingly, it is an object of the present invention to provide a garment hanger, indicator and combination thereof wherein the indicator is solid.

Another object is to provide such devices wherein the indicator is more easily and reliably manufactured than a hollow indicator.

Yet another object is to provide such devices wherein in a preferred embodiment the indicator is durable and reusable, easily formed with raised lettering, and slim and flexible.

It is a further object to provide such devices which are simple and inexpensive to manufacture, use and maintain.

SUMMARY OF THE INVENTION

It is has now been found that the above and related objects of the present invention are obtained in a combination of a novel garment hanger and a novel indicator.

The molded plastic indicator is suitable for attachment to a hook of a molded plastic garment hanger, wherein the hook has a transversely spaced pair of upwardly projecting webs, each web having an aperture therethrough. The indicator comprises a solid plastic body adapted to display indicia relating to a garment on a hanger. The body includes sidewalls, a bottom wall and a top wall. At least one of the body sidewalls defines under the body top wall an outwardly extending lateral projection. A portion of the body is configured and dimensioned to be snugly received intermediate the webs with the lateral projection thereof extending outwardly through the web aperture.

In a preferred embodiment, the body sidewall defines a recess, and the lateral projection is in the recess. The recess is preferably semi-circular in outline. The sidewalls, end walls and top wall of the body are dimensioned to form a rectangular profile.

In another preferred embodiment, in the hanger each of the webs defines an aperture therethrough, and in said indicator body each of the body sidewalls defines an outwardly extending lateral projection. The body portion is configured and dimensioned to be snugly received intermediate the webs with each of the lateral projections extending outwardly through a respective web aperture.

Preferably each body sidewall defines a recess and a lateral projection in the recess. The recesses and lateral projections together define an arrowhead configured and dimensioned to receive the webs with the lateral corners thereof being said lateral projections. The arrowhead is optionally truncated.

The present invention also encompasses a molded plastic garment hanger suitable for use with an indicator for displaying at least one characteristic of a garment hanging therefrom. The garment hanger comprises a hook adapted to engage a rod or other supporting means, the hook being truncated to form a generally planar surface, and a transversely spaced pair of generally planar webs projecting upwardly from and above the hook planar surface for receiving an indicator, at least one of the webs defining an aperture therethrough.

In a preferred embodiment, each web defines an aperture therethrough, and the indicator defines a pair of opposed lateral projections, the projections extending through the web apertures when the indicator is received on the hanger. The web apertures are horizontally aligned.

The present invention further encompasses, in combination, a molded plastic indicator and a molded plastic garment hanger. The plastic indicator comprises a solid body adapted to display indicia relating to a garment on the hanger. The body includes sidewalls, a bottom wall and a top wall, each body sidewall defining under the body top wall an outwardly extending lateral projection. The garment hanger comprises a hook adapted to engage a rod or other supporting means, the hook being truncated to form a generally planar surface, and a transversely spaced pair of generally planar webs projecting upwardly from and above the hook planar surface and receiving the indicator, at least one of the webs defining an aperture therethrough receiving the lateral projections. A portion of the body is configured and dimensioned to be snugly received intermediate the webs with the lateral projections thereof extending outwardly through the web aperture.

In a preferred embodiment, at least one of the body sidewalls defines a recess and a lateral projection in the recess. Preferably, each body sidewall defines a recess and a lateral projection in the recess, and each of the webs defines an aperture therethrough, the web apertures being horizontally aligned and receiving the lateral projections. The recesses and lateral projections together preferably define an arrowhead intermediate the webs, with the lateral corners thereof being the lateral projections. The arrowhead is preferably truncated. The recesses and the webs are semi-circular in outline, and the recess is adapted to receive the web. The sidewalls, end walls and top wall of said body are dimensioned to form a rectangular profile.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawing wherein:

FIG. 1 is a fragmentary exploded isometric view of a garment hanger and indicator combination;

FIG. 2 is a sectional view of the indicator taken along the line 2—2 of FIG. 1;

FIG. 3 is a fragmentary sectional view of the hanger taken along the line 3—3 of FIG. 1;

FIG. 4 is a fragmentary isometric view of the assembly;

FIG. 5 is a fragmentary sectional view of the assembly taken along the line 5—5 of FIG. 4;

FIGS. 6 and 7 are views similar to FIGS. 4 and 5, but of a another embodiment of the assembly; and FIG. 8 is a fragmentary side elevational view of a further embodiment of the assembly.

DETAILED DESCRIPTION OF THE PREFERRED EMBODIMENTS

Referring now to the drawing, and in particular to FIGS. 1 and 4 thereof, therein illustrated is a garment hanger and indicator combination according to the present invention, generally designated by the reference numeral 10. The combination or assembly 10 is in turn composed of a garment hanger according to the present invention, generally designated 12, and an indicator according to the present invention (also called a "sizer" or "cap"), generally designated 14. Each of the elements 12, 14 will now be discussed in turn.

Referring now also to FIG. 3, the normal upper portion of the hook 20 of hanger 12 has been truncated (removed) to leave a planar surface 26. A transversely spaced pair of webs 22 project upwardly from the planar surface 26 (see FIG. 1) of the hook 20 and are reduced in size when compared to the normal upper portion of the hook 20. The extent of the transverse spacing between the webs—that is, from the inner surface of one web to the inner surface of the other web 22—is selected to snugly accommodate the indicator 14, as will be explained in further detail hereinbelow. Each of the webs 22 defines an aperture 24 therethrough, the two apertures 24 of the two webs 22 preferably being transversely or horizontally aligned. Each aperture 24 is preferably of rectangular configuration, with the bottom long side 24*a* thereof preferably being coincident with the planar surface 26. However, if it is desired, the bottom long side 24*a* of the aperture 24 may be disposed other than coincident with the planar surface 26—for example, slightly thereabove as illustrated in FIGS. 6–7. The webs 22 are relatively thin so that the outer surfaces of the webs 22 do not extend laterally beyond the sides of the hangers 12. It will be appreciated that the transversely spaced upstanding webs 22, in conjunction with the portion of the hanger hook 20 therebetween (i.e., the portion of the planar surface 26 therebetween), define a U-shaped chamber 30 open at the top thereof and at both ends thereof. Above apertures 24 the facing inner walls of the web may taper downwardly and inwardly to facilitate passage of the bottom portion of the indicator 13 therebetween.

As will be appreciated by those skilled in the hanger art, the provision of apertures 24 within the webs 22 presents no additional difficulties during molding of the plastic hangers since the hanger already must be manufactured by techniques enabling various openings to be formed within the body of the hanger (not shown). Provision of the U-shaped chamber 30—defined by the webs 22 and the planar surface 26 therebetween—does not present any particular molding problem, especially where the U-shaped chamber does not have any ends thereto.

Because the hangers are typically molded of plastic which is somewhat resiliently flexible in a thin cross section and substantially rigid in a thick cross section, the webs 22, being of relatively thin cross section, provide a natural resiliency which is useful for reasons to be set forth hereinafter. Typically the thickness of the hanger hook 20 and the planar top surface 26 is about 0.16 inch, with each of the webs 22 having a thickness about ⅓ thereof.

As illustrated in FIGS. 1–7, the hook planar surface 26 is a top surface and webs 22 extend upwardly therefrom. Accordingly, the U-shaped chamber 30 is open at the top of the hook such that the indicator 14 will be disposed on the top of the hook 12. This is a preferred arrangement as the top of the hook is generally visually accessible to customers. In particular applications, however, the indicators may be more clearly and easily readable if the indicator is disposed not on the top of the hook, but rather on another surface thereof. Thus, referring now to FIG. 8, the hook planar surface 26 may be an end surface (typically where the hook would normally make the curve between the top and bottom thereof), and the webs 22 extend transversely thereto (that is, in the direction of the aforementioned curve). For particular applications, this assembly 10" may position the indicator 14' in a better location on the hanger 12".

Referring now to FIGS. 2 and 5 as well, the indicator 14 is preferably molded of the same plastic as the hanger 12. The body of indicator 14 is preferably of generally rectangular design, having a top wall 40, bottom wall 42, a pair of end walls 44 and a pair of sidewalls 46. The maximum thickness of the indicator 14 is substantially equal to that of the hanger hook 20 and planar surface 26. The height of the indicator 14 is about 0.5 inch, about twice the height of the web 22 of the hanger 12. Preferably, in order to enhance the appearance of the combination as a single unit, the indicator end walls 44 and side walls 46 will flow into the corresponding walls of the planar surface 26, as illustrated in FIGS. 4 and 5. Alternatively, the indicator may be of non-rectangular configuration, if desired.

Indicia 48 to reflect the size, manufacturer, retailer, of the garment, or other characteristics of the garment, may be molded onto the upper wall 40, sidewalls 46 or end walls 44 of the indicator 14, as suggested by the letter "L" illustrated on top wall 40 and sidewalls 46. Alternatively, one or more of the aforementioned walls may be blank or bear a gummed label affixed thereto and containing the desired indicia 48.

Each sidewall 46 defines between the end walls 44 and under the top wall 46, an outwardly extending lateral projection 60. The portion of the sidewall 46 about the lateral projection 60 is configured and dimensioned to be snugly received intermediate the webs 22 of the hanger 12, with the lateral projections 60 thereof extending outwardly through respective web apertures 24, as best seen in FIGS. 4 and 5, thereby to lock the indicator onto the hanger in an interference fit. Preferably each of the sidewalls 46 defines a slight or shallow recess 62, as well as the lateral projection 60, with the lateral projection 60 preferably being disposed centrally in the recess 62. As best seen in FIG. 2, the recesses 62 and lateral projections 60 of the indicator sidewalls 46 together define intermediate the webs 22 an arrowhead, generally designated 64, with the lateral corners 66 of the arrowhead 64 being the lateral projections 60 (which extend through the web apertures 24). The web 22 and recess 62 are preferably both semi-circular in outline, with each web 22 being adapted to fit within its respective recess 62. Of course the web 22 and recess 62 may be of other configurations, but preferably with the recess still being able to receive the web.

It will be noted that in the alternate embodiment 10', as illustrated in FIGS. 6 and 7, the bottom long wall 24*a*' of aperture 24' of hanger 12' of the combination is spaced slightly above the plane defined by the planar top surface 26.

The present invention thus provides for a reasonably secure attachment of the indicator to the garment hanger via an interference fit, with the indicator being easily and inexpensively molded because of its solid and unapertured nature. Where security of the attachment of the indicator to the garment hanger is of lesser concern, only one of the indicator sidewalls 46 need be provided with a lateral projection 60 and only one of the hook webs 22 need be provided with an aperture 24. The other web 22 (that is, the one without the aperture 34) will simply be snugly received within the indicator sidewall recess 46. That other web 22 need not be flexible as it does not have to pass over a sidewall projection 60.

It will be appreciated that, in the indicator/hanger combination, the abutment of a generally planar indicator bottom wall 42 on the generally planar hook top surface 26, in cooperation with the abutment of the indicator recesses 62 on the hanger webs 22, provides a high level of stability to the assembly. Accordingly, the interaction of the indicator projection 60 and the hanger web aperture 24 serves mainly to lock the indicator to the hanger against accidental misplacement due to inversion of the assembly or an intentional separation thereof.

The hangers and indicators may be made of any of a variety of different plastics by techniques well-known in the plastic art—e.g., extrusion, injection molding, die cutting, etc. Alternatively, the hanger may be formed of wire. The mating surfaces of the hook web 22 and indicator sidewall recess 46 are preferably semi-circular, although clearly mating surfaces of a different configuration (e.g., chevrons) may be used instead.

To summarize, the present invention provides a garment hanger, indicator and combination thereof where the indicator is solid and more easily and reliably manufactured than a hollow indicator. The indicator is durable and re-usable, lends itself to the use of raised lettering, and enables a slim profile which is flexible. The device is simple and inexpensive to manufacture, use and maintain.

Now that the preferred embodiments of the present invention have been shown and described in detail, various modifications and improvements thereon will become relatively apparent to those skilled in the art. Accordingly, the spirit and scope of the present invention is to be construed broadly and limited only by the appended claims, and not by the foregoing specification.

I claim:

1. A molded plastic indicator suitable for attachment to a hook of a molded plastic garment hanger, wherein the hook has a transversely spaced pair of outwardly projecting webs, at least one of said webs having an aperture therethrough, said indicator comprising:

a solid plastic body adapted to display indicia relating to a garment on a hanger, said body defining a rectangular profile with parallel sidewalls, a bottom wall and a top wall, and a pair of end walls connecting said parallel sidewalls and said top and bottom walls, at least one of said body sidewalls defining under said body top wall an outwardly extending lateral projection, a portion of said body being configured and dimensioned to be snugly received intermediate the webs with said lateral projection thereof extending outwardly through the web aperture.

2. The indicator of claim 1 wherein said body sidewall defines a recess, and said lateral projection is in said recess.

3. The indicator of claim 2 wherein said recess is semi-circular in outline.

4. The indicator of claim 1 wherein in the hanger each of the webs defines an aperture therethrough and in said indicator body each of said body sidewalls defines an outwardly extending lateral projection, said body portion being configured and dimensioned to be snugly received intermediate the webs with each of said lateral projections extending outwardly through a respective web aperture.

5. The indicator of claim 1 wherein each said body sidewall defines a recess and a lateral projection in said recess.

6. The indicator of claim 5 wherein said recesses and lateral projections together define an arrowhead configured and dimensioned to receive the webs with the lateral corners thereof being said lateral projections.

7. The indicator of claim 2 wherein said arrowhead is truncated.

8. The indicator of claim 1 wherein said body includes end walls connecting said body sidewalls, said lateral projection being spaced from said body end walls.

9. A molded plastic garment hanger suitable for use with an indicator for displaying at least one characteristic of a garment hanging therefrom, said garment hanger comprising:

(A) a hook adapted to engage a rod or other supporting means, said hook being truncated to form a generally planar surface; and (B) a transversely spaced pair of generally planar webs projecting upwardly from and above said hook planar surface, at least one of said webs defining an aperture means therethrough for receiving an indicator.

10. The hanger of claim 9 wherein each of said webs defines an aperture means therethrough.

11. The hanger of claim 10 wherein, when the indicator defines a pair of opposed lateral projections, the projections extend through respective web aperture means when the indicator is received on said hanger.

12. The hanger of claim 11 wherein said web aperture means are horizontally aligned.

13. The hanger of claim 9 wherein the opposing faces of said webs above said aperture means are inclined downwardly and inwardly.

14. The hanger of claim 9 wherein said hook planar surface is a top surface, and said webs extend upwardly.

15. The hanger of claim 9 wherein said hook planar surface is an end surface, and said webs extend transversely thereto.

16. In combination, a molded plastic indicator and a molded plastic garment hanger, (A) said plastic indicator comprising a solid body adapted to display indicia relating to a garment on said hanger, said body including defining a rectangular profile with parallel sidewalls, a bottom wall and a top wall, and a pair of end walls connecting said parallel sidewalls and said top and bottom walls, at least one of said body sidewalls defining under said body top wall an outwardly extending lateral projection; and (B) said garment hanger comprising a hook adapted to engage a rod or other supporting means, said hook being truncated to form a generally planar surface, and a transversely spaced pair of generally planar webs projecting upwardly from and above said hook planar surface and receiving said indicator, at least one of said webs defining an aperture therethrough receiving a respective one of said lateral projections in an interference fit;

a portion of said indicator body being configured and dimensioned to be snugly received intermediate said webs with said lateral projection thereof extending outwardly through said web aperture.

17. The combination of claim 16 wherein at least one of the body sidewalls defines a recess and a lateral projection in the recess.

18. The combination of claim 16 wherein each said body sidewall defines a recess and a lateral projection in the recess.

19. The combination of claim 18 wherein said recesses and lateral projections together define an arrowhead intermediate said webs, with the lateral corners thereof being said lateral projections.

20. The combination of claim 18 wherein said recesses and said webs are semi-circular in outline, and said recess is adapted to receive said web.

21. The combination of claim 19 wherein said arrowhead is truncated.

22. The combination of claim 18 wherein each of said webs defines an aperture therethrough.

23. The combination of claim 19 wherein said web apertures are horizontally aligned and receive said lateral projections.

24. The combination of claim 16 wherein said body are dimensioned to form a rectangular profile.

25. The combination of claim 16 wherein said hook planar surface is a top surface, and said webs extend upwardly.

26. The combination of claim 16 wherein said hook planar surface is an end surface, and said webs extend transversely thereto.

27. The combination of claim 16 wherein in said hanger each of said webs defines an aperture therethrough and in said indicator body each of said body sidewalls defines an outwardly extending lateral projection, said body portion being configured and dimensioned to be snugly received intermediate said webs with each of said lateral projections extending outwardly through a respective web aperture.

28. A molded plastic indicator suitable for attachment to a hook of a molded plastic garment hanger, wherein the hook has a transversely spaced pair of outwardly projecting webs, each of said webs having an aperture therethrough, said indicator comprising:

a solid plastic body adapted to display indicia relating to a garment on a hanger, said body defining a profile with sidewalls, a bottom wall and a top wall, and a pair of end walls connecting said sidewalls and said top and bottom walls, each of said body sidewalls defining under said body top wall an outwardly extending lateral projection, a portion of said body being configured and dimensioned to be snugly received intermediate the webs with said lateral projections thereof extending outwardly through the web apertures.

29. In combination, a molded plastic indicator and a molded plastic garment hanger, (A) said plastic indicator comprising a solid body adapted to display indicia relating to a garment on said hanger, said body including defining a profile with sidewalls, a bottom wall and a top wall, and a pair of end walls connecting said sidewalls and said top and bottom walls, at least one of said body sidewalls defining under said body top wall an outwardly extending lateral projection; and (B) said garment hanger comprising a hook adapted to engage a rod or other supporting means, said hook being truncated to form a generally planar surface, and a transversely spaced pair of generally planar webs projecting upwardly from and above said hook planar surface and receiving said indicator, at least one of said webs defining an aperture therethrough receiving a respective one of said lateral projections in an interference fit;

a portion of said indicator body being configured and dimensioned to be snugly received intermediate said webs with said lateral projection thereof extending outwardly through said web aperture.

30. The combination of claim 16 wherein in said hanger each of said webs defines an aperture therethrough and in said indicator body each of said body sidewalls defines an outwardly extending lateral projection, said body portion being configured and dimensioned to be snugly received intermediate said webs with each of said lateral projections extending outwardly through a respective web aperture.

* * * * *